United States Patent [19]

Shen-Tu

[11] Patent Number: 4,785,877

[45] Date of Patent: Nov. 22, 1988

[54] FLOW STREAMLING DEVICE FOR TRANSFER LINE HEAT EXCHANGES

[75] Inventor: Carlton K. Shen-Tu, Pasadena, Calif.

[73] Assignee: Santa Fe Braun Inc., Alhambra, Calif.

[21] Appl. No.: 864,018

[22] Filed: May 16, 1986

[51] Int. Cl.[4] ..... F28F 19/00

[52] U.S. Cl. ..... 165/134.1; 165/174; 165/178

[58] Field of Search ..... 165/174, 178, 134.1

[56] References Cited

U.S. PATENT DOCUMENTS

| | | | |
|---|---|---|---|
| 307,480 | 11/1884 | Luttgens | 165/174 X |
| 1,184,199 | 5/1916 | Morison | 165/174 |
| 2,225,615 | 12/1940 | Bay | 165/174 X |
| 3,073,875 | 1/1963 | Braconier et al. | 260/679 |
| 3,174,924 | 3/1965 | Clark et al. | 208/48 |
| 3,442,613 | 5/1969 | Grotz | 23/199 |
| 3,456,719 | 7/1969 | Palchik | 165/142 |
| 3,504,739 | 4/1970 | Pearce et al. | 165/134 |
| 3,574,781 | 4/1971 | Racine et al. | 260/683 |
| 3,607,153 | 9/1971 | Cijer | 48/102 |
| 3,707,186 | 12/1972 | Zorrilla et al. | 165/178 X |
| 3,880,621 | 4/1975 | Schneider et al. | 55/97 |
| 3,903,963 | 9/1975 | Fuki et al. | 165/142 |
| 4,097,544 | 6/1978 | Hengstebeck | 260/683 |
| 4,103,738 | 8/1978 | Aydelott et al. | 165/178 |
| 4,119,140 | 10/1978 | Cates | 165/178 X |
| 4,151,217 | 4/1979 | Amano et al. | 260/683 |
| 4,248,834 | 2/1981 | Tokumitsu | 422/200 |
| 4,254,819 | 3/1981 | Worrell | 165/178 X |
| 4,254,825 | 3/1981 | Smazu | 165/134.1 X |
| 4,288,408 | 9/1981 | Guth et al. | 422/193 |
| 4,366,003 | 12/1982 | Korte et al. | 134/18 |
| 4,384,160 | 5/1983 | Skraba | 585/650 |
| 4,397,740 | 8/1983 | Koontz | 208/48 Q |
| 4,405,440 | 9/1983 | Gwyn | 208/48 Q |
| 4,457,364 | 7/1984 | DiNicolaustonio et al. | 165/178 X |

FOREIGN PATENT DOCUMENTS

| | | | |
|---|---|---|---|
| 0105442 | 4/1984 | European Pat. Off. . | |
| 657100 | 5/1929 | France | 165/174 |
| 939389 | 11/1948 | France | 165/174 |
| 1222655 | 6/1960 | France . | |
| 2269050 | 11/1976 | France . | |
| 2419489 | 3/1978 | France . | |
| 82389 | 8/1956 | Netherlands | 165/174 |
| 634608 | 3/1950 | United Kingdom | 165/174 |
| 1291847 | 12/1969 | United Kingdom . | |

*Primary Examiner*—Ira S. Lazarus
*Assistant Examiner*—Peggy Neils
*Attorney, Agent, or Firm*—Lyon & Lyon

[57] ABSTRACT

Shell-and-tube transfer line heat exchangers are disclosed, having inlet ends with a flow streamlining device comprising, in combination:

flared ends, preferably in the form of hollow truncated cones, whose smaller ends are aligned with and mated to the inlet ends of the heat exchange tubes in a conventional transfer line heat exchanger, the ends of these heat exchange tubes being contained within tubesheets, the flared ends extending away from the inlet and tubesheet, and peaked gas guides, preferably in the form of closed, concave gables having rounded, smooth tops, which rise between the rims or edges of adjacent larger ends of the flared ends and enclose the spaces between these rims or edges.

Methods of quenching high temperature gases while recovering useable heat therefrom using these modified transfer line heat exchangers are also disclosed.

15 Claims, 2 Drawing Sheets

FIG. 4
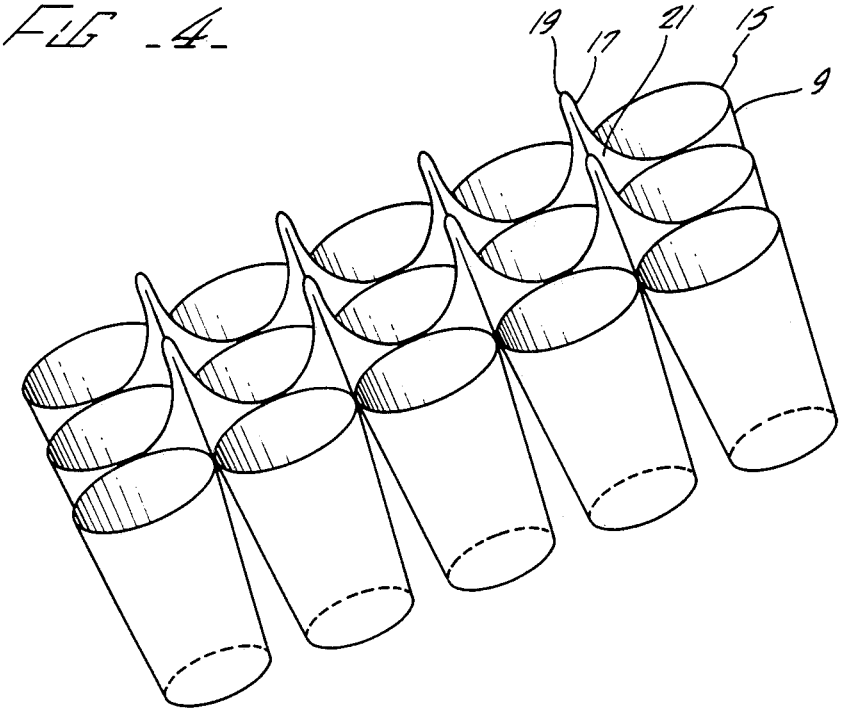
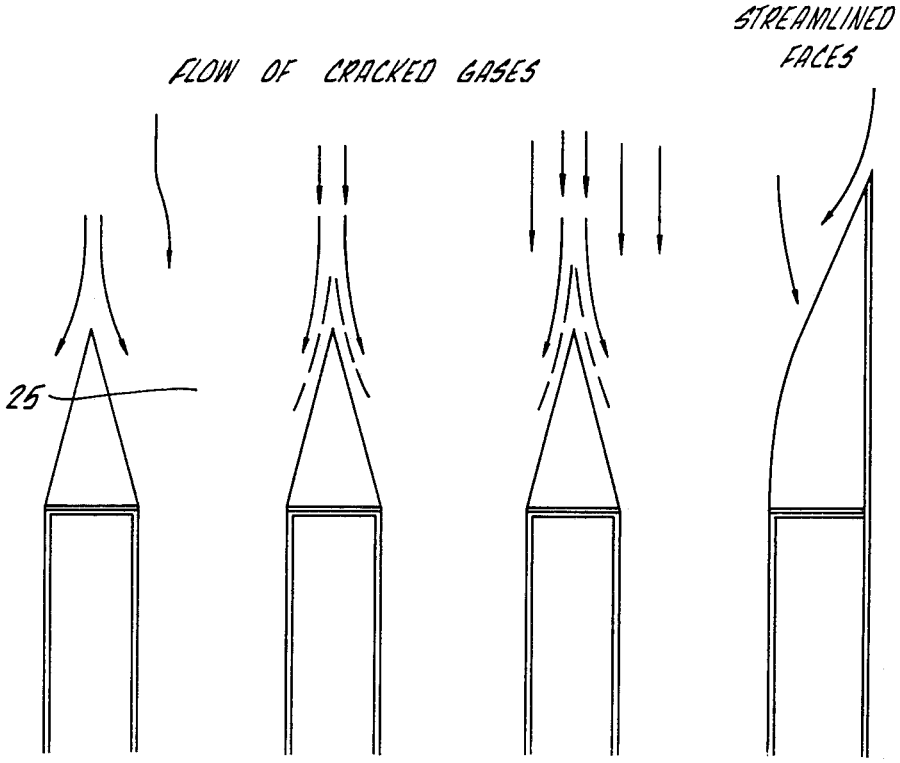
FIG. 5

FLOW STREAMLINING DEVICE FOR TRANSFER LINE HEAT EXCHANGES

FIELD OF THE INVENTION

This invention relates to novel heat exchangers and to chemical processes involving their use. More particularly, this invention relates to new and improved indirect shell-and-tube heat exchangers of the type known as transfer line heat exchangers (TLEs), and to improved processes of quenching or recovering heat from high temperature fluids, and particularly high temperature gases, which involve their use. These novel TLEs are modified at their inlet ends in two respects in comparison to conventional TLEs by means which, taken together, can be characterized as a flow streamlining device. These modifications minimize or prevent inlet end fouling, which commonly occurs in conventional TLEs due to coke buildup resulting from condensation or precipitation, and then decomposition at high temperature, of tars, high polymers or other high molecular weight materials during processing. Their use also reduces the overall down time required to clean the inlet ends of the heat transfer tubes should inlet end fouling eventually occur.

BACKGROUND OF THE INVENTION

Transfer line heat exchangers are in widespread use in commercial chemical processing. In general, they operate to cool hot gases by passing these gases through a bundle of tubes in heat exchange relationship with a cooling fluid, such as water, passing around the outside, or shell side, of the tubes and contained within a defined area along the tubes by means of a pair of tubesheets which are generally perpendicular to the tubes contained within them. In certain processes, the heat removed from the process gas is sufficient to vaporize the fluid on the shell side. In such cases if water is used as the cooling fluid the heat exchanger also becomes a steam generator.

TLEs are commonly used to cool very hot process gases. For example, they are used in processes for producing ammonia such as that disclosed in U.S. Pat. No. 3,442,613, issued May 6, 1969 to Grotz, to cool the approximately 850° F. ammonia-containing gas exiting a syngas converter. They are also used in olefin plants and in other hydrocarbon cracking operations to recover usable heat from reactor gases, e.g., gases exiting pyrolysis furnace coils at temperatures above 1500° F. To avoid secondary reactions leading to less valuable or useless products, the residence time spent by the exiting gases between the furnace coil outlet and the TLE inlet should be minimized. The pressure drop across the TLE should also be minimized, since cracking selectivity towards more useful products in the furnace is directly dependent on cracking-coil outlet pressure, and ordinarily a pressure rise of no more than a few p.s.i. at the furnace outlet is all that can be tolerated if process stability is to be maintained. A discussion of va ious TLE designs is found in Albright et al, "Pyrolysis Theory and Industrial Practice (New York: Academic Press, 1983), Chapter 18.

The efficiency with which heat is recovered by a TLE can have a marked effect on plant operating costs. Inlet end fouling due to coke buildup can impair this efficiency to a substantial extent. At higher temperatures in processes where coking is a problem, very hard and often refractory layers of coke or carbon can form on the walls of the reactor, conduits and heat exchangers. This coke buildup will cause an increase in pressure drop across the TLE, which is detrimental to cracking yields and eventually requires a shutdown of this equipment to permit decoking.

It is difficult to examine in detail all of the reaction mechanisms occurring in chemical processes carried out at extremely high temperatures and pressures. Consequently, the mechanism(s) responsible for coke buildup in processes involving the use of TLEs have never been entirely elucidated. Some believe that it is important to keep the TLE tubes at a temperature above the dew point of any materials present which have a tendency to coke or deposit; see U.S. Pat. No. 4,405,440, issued Sept. 20, 1983 to Gwyn. Others believe it to be important to keep the connector between the reactor and the TLE at a temperature below 450° C., well below that of the exiting gas stream, on the theory that if a gas stream, e.g., one flowing at a mass velocity below 50 kg/m$^2$ per second, is quickly cooled to a temperature well below the temperature at the reactor exit coking will not occur; see U.S. Pat. No. 4,151,217, issued Apr. 24, 1979 to Amano et al, and U.S. Pat. No. 4,384,160, issued May 17, 1983 to Skraba.

Other prior art methods of ameliorating the coking problem or attempting to prevent coking from occurring altogether have generally fallen into one of three categories:

prevention of coke buildup by means of substances added to the gas stream (see U.S. Pat. Nos. 3,174,924, issued Mar. 23, 1965 to Clark et al; 4,097,544, issued June 27, 1978 to Hengstebeck, and the Skraba patent, each of which discloses injecting a quench fluid or fluids into the gas stream being cooled) or added to the TLE tubes themselves (see U.S. Pat. Nos. 3,073,875, issued Jan. 15, 1963 to Braconier et al and 4,288,408, issued Sept. 8, 1981 to Guth et al, which disclose methods of forming a liquid or a gas film on the inner surfaces of the reactor, the tubes or both);

mechanical means for cleaning out coke deposits once formed; see U.S. Pat. No. 4,248,834, issued Feb. 3, 1981 to Tokumitsu, which discloses decoking by feeding air through the system after interrupting the gas stream exiting the reactor, and U.S. Pat. No. 4,366,003, issued Dec. 28, 1982 to Korte et al, which discloses the use of jet nozzles positioned above the TLE inlet openings to periodically flush them clean, and various mechanical modifications of the TLEs or surrounding equipment, such as the use of inlet screens or sieve mediums (U.S. Pat. No. 3,880,621, issued Apr. 29, 1975 to Schneider et al), varying tube size to equalize flow through each of the TLE tubes (U.S. Pat. No. 4,397,740, issued Aug. 9, 1983 to Koontz), "insulating" the tubes with heat transfer medium which is thinner at the inlet end and increases in thickness gradually or uniformly to a point at or near the end of the tubes (the Gwyn patent), using an expansion section and conduits to inject water to form a steam sheath adjacent to the walls of the expansion section (U.S. Pat. No. 3,574,781, issued Feb. 14, 1968 to Racine et al), using a precooler closely followed by a pair of aftercoolers connected in parallel (U.S. Pat. No. 3,607,153, issued Sept. 21, 1971 to Cijer), connecting a conically ended heat exchanger directly to a cracking heater outlet (U.S. Pat. No. 3,456,719, issued July 22, 1969 to Palchik), and using a bundle of triple tubes (U.S. Pat. No. 3,903,963, issued Sept. 9, 1975 to Fuki et al).

None of these expedients has fully served the intended purpose, and coking at TLE inlet ends remains a significant problem to the involved segments of the chemical processing industry.

There has now been discovered a simple combination of mechanical expedients which minimizes or prevents entirely TLE inlet end fouling by coke buildup during high temperature chemical processing, and thus minimizes increased pressure drop across the system. This in turn optimizes heat recovery, process dynamics and process stability, and permits longer process runs between shutdowns.

It is, therefore, an object of this invention to provide novel transfer line heat exchangers.

Another object of this invention is to provide improved processes of quenching or recovering heat from high temperature fluids, and particularly high temperature gases, which involve the use of my novel transfer line heat exchangers.

A further object of this invention is to provide novel transfer line heat exchangers whose inlet ends are modified by means of a novel flow streamlining device.

A still further object of this invention is to provide novel transfer line heat exchangers which minimize or prevent inlet end fouling due to coke buildup.

These and other objects, as well as the nature, scope and utilization of this invention, will become readily apparent to those skilled in the art from the following description, the drawings and the appended claims.

SUMMARY OF THE INVENTION

The novel flow streamlining device of this invention includes:

flared end means, preferably in the form of hollow truncated cones, with the smaller ends aligned with and mated to the inlet ends of the heat exchange tubes in a conventional TLE, the ends of these heat exchange tubes being contained within tubesheets which are generally perpendicular to the tubes, the flared end means extending away from the inlet end tubesheet, and peaked gas guide means, preferably in the form of closed, concave gables having rounded, smooth tops, which rise between the rims or edges of adjacent larger ends of the flared end means and enclose the spaces between these rims or edges.

The peaked gas guide means, in combination with the flared end means, almost completely eliminate the tube sheet impact area perpendicular to the gas flow on which hot gases exiting a reactor impinge in a conventional TLE, thus lessening the opportunity for condensible or precipitatible materials in the gases entering the novel TLEs of this invention to deposit at the TLE inlet end and ultimately form coke deposits. The topology of this novel flow streamlining device is somewhat similar to that of the bottom half of an egg carton, as will be evident from accompanying FIG. 4.

BRIEF DESCRIPTION OF THE DRAWINGS

FIG. 4 is a more comprehensive plan view of a flow streamlining device of the invention, showing multiple flared end means having peaked gas guide means between them.

FIG. 5 is a cross-sectional view of the portion of the inlet end of a TLE modified in accordance with the invention shown in FIG. 3.

DETAILED DESCRIPTION OF THE INVENTION

I do not wish to be bound by any particular mechanism or theory advanced to explain the mode of operation of my novel flow streamlining device, the advantages obtainable therefrom, or the mechanism(s) of chemical reactions, physical phenomena or combinations thereof occurring in and around this device as positioned in accordance with the invention at the inlet end of a TLE situated at or near the exit of a chemical reactor generating a stream of high temperature gas. I believe, however, that TLE inlet end fouling by coke deposit formation is chiefly due to at least one and possibly three distinct mechanisms, each of which can contribute to slow cooling at and in the vicinity of the TLE inlet end, a condition believed to be conducive to coke deposition.

First, solid coke particles entrained in the entering gases can impact on TLE surfaces, particularly surfaces perpendicular to the direction of the gas flow, and progressively build up deposits on these surfaces. Ultimately, such deposits can block the inlet ends of the TLE tubes by "scaffolding" or cantilevering across the tube openings.

Second, nonideal gas flow distribution in the TLE at its inlet and beyond, and on the hot tubesheet, can cause turbulent eddies and backmixing of the gases present, cooling them to also result in increased fouling.

Third, coke and pyrolysis tars, and other condensible or precipitatible materials, can condense or deposit on any surface of the TLE or adjacent equipment which has been allowed to cool to below the dew point of the condensing or depositing material.

Figure 1:
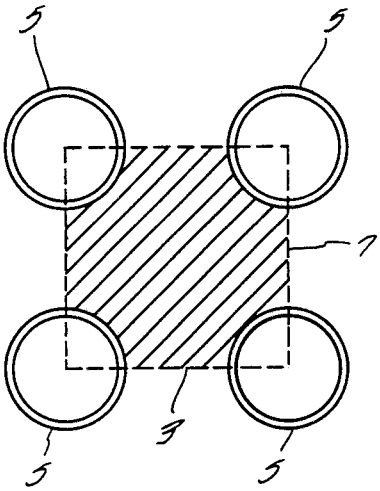
FIG. 1 PRIOR ART
FIG. 1 is an end view of a portion of the inlet end of a typical TLE, showing the ends of four tubes and the tube sheet impact area between them perpendicular to the direction of gas flow.

In hitherto commonly used TLEs, the ratio of total tube inlet area to flat surface area on the surrounding tubesheet can be quite small. As illustrated in FIG. 1, for example, a typical TLE 1 may have less than 20% of the total surface area of its tubesheet 3 perforated with heat exchange tube inlets 5; see, for example, the Fuki et al, Hengstebeck and Koontz patents. Whatever portion of the flat surface area on the tubesheet 1 not perforated by heat exchange tube inlets 5 becomes an impact surface (the shaded area within the dotted boundary of FIG. 1, for example), one which is normally comparatively cool by virtue of contact with heat exchange fluid on its underside and thus one which can give rise to coke deposits by any or all of the above-mentioned mechanisms.

Figure 2:
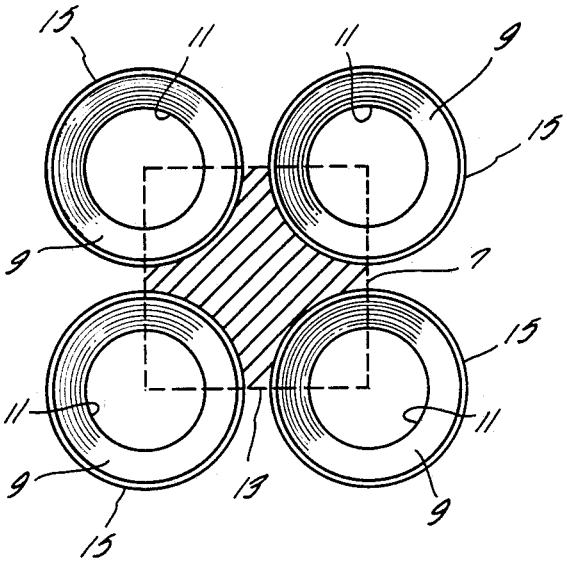
FIG. 2 is an end view of a portion of the inlet end of a TLE drawn to the same dimensions as the TLE of FIG. 1 but partially modified in accordance with the invention, showing four tubes containing flared end means having no peaked gas guide means between them so as to illustrate the reduced tube sheet impact area between the inlets of the tubes.

Considering now the present invention and its use in minimizing or preventing TLE inlet end fouling, with reference to the remaining accompanying drawings:

As illustrated in FIG. 2, transfer line exchanger 7, with heat exchange tube inlet ends (not shown) aligned with and mated to the smaller ends 11 of flared end means 9 in the form of hollow truncated cones, has a greatly reduced impact area on its tubesheet 13 (the shaded area within the tubesheet portion 13 of FIG. 2) in comparison to that of the TLE of FIG. 1. The hollow truncated cones 9 are configured in such a manner that the rims or edges of their larger ends 15 closely abut one another, and preferably come within from zero to about $\frac{3}{8}$ inches of one another. Typical dimensions for such hollow truncated cones 9 are as follows: a height as measured along the central axis of the cone of from about $\frac{5}{8}$ to about 8 inches, and preferably from about $1\frac{1}{4}$ to about $2\frac{1}{2}$ inches, a diameter at the rim or edge of the smaller end 11 of from about $\frac{1}{2}$ to about $2\frac{1}{2}$ inches, and preferably from about 1 to about $1\frac{1}{2}$ inches, and a diameter at the rim or edge of the larger end 15 of from about $\frac{3}{4}$ to about 4 inches, and preferably from about $1\frac{1}{4}$ to about $2\frac{1}{2}$ inches, thus giving a typical pitch or slope from the smaller end 11 of the hollow truncated cone 9 to the larger end 15 of from about 5 to about 35 degrees, and preferably from about 10 to about 25 degrees.

Figure 3:
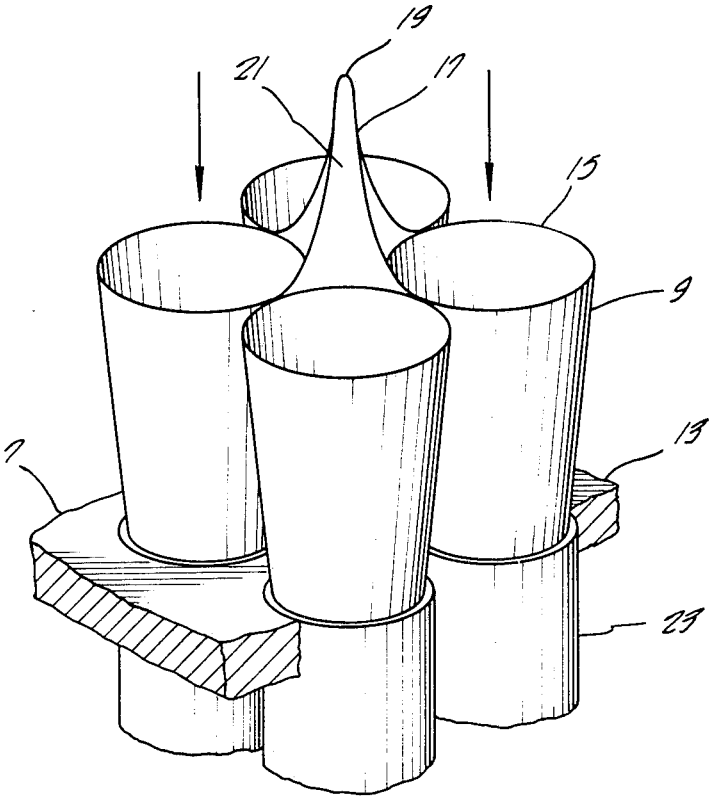
FIG. 3 is a plan view of a portion of the inlet end of a TLE modified in accordance with the invention, showing four tubes containing flared end means having a peaked gas guide means between them.

The peaked gas guide means 17 in the form of closed, concave gables having rounded, smooth tops 19 and concave sides 21 which gently slope downwardly from the rounded tops 19 to the rims or edges of the larger ends 15 of the hollow truncated cones 9, as shown in FIG. 3 and FIG. 4, rise between the rims or edges of the larger ends 15 of the hollow truncated cones 9 to enclose and cover the remaining flat surface area on the tubesheet 13 (again, for example, the shaded area within the tubesheet portion 13 of FIG. 2). Thus, the gases exiting a reactor (not shown), instead of impinging on flat tubesheet surfaces, stream down the concave sides 21 of the closed, concave gables 17, enter the enlarged inlets provided by the hollow truncated cones 9, and then pass beyond the tubesheet 13 through the TLE's heat exchange tubes 23. As shown in FIG. 5, the impact area perpendicular to the gas flow at the inlet end 25 of a thus-modified TLE is almost completely eliminated, turbulent eddies and backmixing are minimized, and gases carrying entrained coke particles, tarry substances or other tar and coke formers are guided past the closed concave gables 17 through the hollow truncated cones 9 with minimal recirculation. And, since no relatively cooler surfaces on the tubesheet 13 remain for the gas to contact, a minimum amount of heat is lost by the gases in the inlet area. This helps alleviate problems caused by condensation, which in turn helps reduce coke deposits.

The number of sides the peaked gas guide means will have in any particular flow streamlining device of this invention applied to the inlet end of a TLE will depend upon the geometric arrangement of the TLE's heat exchange tubes. The devices shown in FIGS. 3 and 4 have four sided closed, concave gables, but peaked gas guide means having three, five or more sides are also possible, and thus are within the scope of the invention. It is desirable to maximize the height of the peaked gas guide means within the confines of the flared end means present, since the higher the peaked gas guide means the smoother and more streamlined the gas flow will be. Hence, typical height of the peaked gas guide means, preferably in the form of closed, concave gables, will be from about three to about six times, and preferably from about 4 to about 5 times, the inside diameter of the TLE's heat exchange tubes, all measured from the smaller end of the truncated cone. The overall height of the flow streamlining device of this invention (flared end means plus peaked gas guide means) can thus typically range from about 1 to about 12 inches, and preferably from about $2\frac{1}{2}$ to about 8 inches.

The novel flow streamlining device can be made of any material suitable for use in a TLE including, but not limited to, steel, cast iron and ceramic materials, with the choice of materials being dictated by cost and the conditions (exiting gas temperature, reactor pressure, composition of the gas being quenched, nature of the heat transfer fluid, etc.) of the chemical process being carried out.

The above discussion of this invention is directed primarily to preferred embodiments and practices thereof. It will be readily apparent to those skilled in the art that further changes and modifications in the actual implementation of the concepts described herein can readily be made without departing from the spirit and scope of the invention as defined by the following claims.

I claim:

1. A flow streamlining device for an inlet end of an indirect shell-and-tube transfer line heat exchanger whose heat exchange tubes are contained within a tubesheet, comprising:

(1) flared end means, each flared end means having a smaller end and a larger end, the flared end means extending away from the tubesheet having their smaller ends in alignment with and mated to inlet ends of heat exchange tubes, and (2) peaked gas guide means, proximate to the flared end means, having sides sloping upwardly from and enclosing spaces between rims of the larger ends of the flared end means, wherein the peaked gas guide means comprise closed, concave gables having a height from about three to about twelve times an inside diameter of the heat exchange tubes.

2. A flow streamlining device as recited in claim 1 wherein the flared end means comprise hollow truncated cones.

3. A flow streamlining device as recited in claim 2 wherein the rims of the larger ends of the hollow truncated cones closely abut one another.

4. A flow streamlining device as recited in claim 3 wherein the height of the hollow truncated cones, as measured along the central axis of the cone, is from about $\frac{5}{8}$ to about 8 inches.

5. A flow streamlining device as recited in claim 1 wherein the closed, concave gables have rounded, smooth tops.

6. A flow streamlining device as recited in claim 4 wherein the closed, concave gables have rounded, smooth tops.

7. In a method of quenching high temperature gases while recovering usable heat therefrom by means of an indirect shell-and-tube transfer line heat exchanger whose heat exchange tubes are affixed to a tubesheet, the improvement comprising streamlining high temperature gas flow into heat exchange tubes comprising the steps of:

(1) directing the gas flow through flared end means, each flared end means having a larger end and a smaller end, the flared end means extending away from the tubesheet and having their smaller ends in alignment with and mated to inlet ends of the heat exchange tubes, and (2) impinging the gas flow onto peaked gas guide means, comprised of closed, concave gables proximate to the flared end means, having sides sloping upwardly from and enclosing spaces between rims of the larger ends of the flared end means, the closed, concave gables having a height from about three to about twelve times an inside diameter of the heat exchange tubes.

8. A method as recited in claim 7 wherein the flared end means comprise hollow truncated cones.

9. A method as recited in claim 8 wherein the rims of the larger ends of the hollow truncated cones closely abut one another.

10. A method as recited in claim 9 wherein the height of the hollow truncated cones, as measured along the central axis of the cone, is from about $\frac{5}{8}$ to about 8 inches.

11. A method as recited in claim 10 wherein the closed, concave gables have rounded, smooth tops.

12. A method as recited in claim 10 wherein the closed, concave gables have rounded, smooth tops.

13. A method of quenching high temperature gases while recovering usable heat therefrom by means of an indirect shell-and-tube transfer line heat exchanger whose heat exchange tubes are affixed to a tubesheet, comprising the step of streamlining high temperature gas flow into heat exchange tubes comprising the steps of:

(1) directing the gas flow into hollow truncated cones, each of the cones having a larger end and a smaller end, wherein rims of the larger ends of the cones closely abut one another, there cones extending away from the tubesheet and having their smaller ends in alignment with and mated to inlet ends of the heat exchange tubes, and (2) impinging the gas flow onto closed, concave gables, proximate to the hollow truncated cones, having rounded, smooth tops and sides sloping upwardly from and enclosing the spaces between the rims of the larger ends of the hollow truncated cones, the closed, concave gables having a height from about three to about twelve times an inside diameter of the heat exchange tubes.

14. A flow streamlining device as recited in claim 1 wherein the rims of the larger ends of the flared end means closely abut from zero to about $\frac{3}{8}$ inches of one another.

15. A method as recited in claim 7 wherein the rims of the larger ends of the flared end means closely abut from zero to about $\frac{3}{8}$ inches of one another.

* * * * *